US008316569B1

(12) United States Patent
Chvala

(10) Patent No.: US 8,316,569 B1
(45) Date of Patent: Nov. 27, 2012

(54) SHOTGUN MOUNTING SYSTEM

(75) Inventor: John R. Chvala, Grafton, WI (US)

(73) Assignee: Advanced Technology International USA, LLC, Milwaukee, WI (US)

( * ) Notice: Subject to any disclaimer, the term of this patent is extended or adjusted under 35 U.S.C. 154(b) by 0 days.

(21) Appl. No.: 13/104,104

(22) Filed: May 10, 2011

(51) Int. Cl.
*F41C 27/00* (2006.01)

(52) U.S. Cl. ..... 42/90; 42/124

(58) Field of Classification Search ..... 42/72, 90, 42/96, 124, 127
See application file for complete search history.

(56) References Cited

U.S. PATENT DOCUMENTS 859,932 A * 7/1907 Edwards ..... 42/96
3,555,687 A * 1/1971 Joseph ..... 42/124
4,455,776 A * 6/1984 Ashley et al. ..... 42/124
2004/0226211 A1* 11/2004 Keeney et al. ..... 42/71.01
2010/0037505 A1* 2/2010 Romer ..... 42/124

OTHER PUBLICATIONS

Mesa Tactical. <http://web.archive.org/web/20080819221817/http://www.mesatactical.com/index.php?id=59>. Aug. 19, 2008.*
CA870 Shotgun and Receiver Shell. <http://web.archive.org/web/20090421111228/http://www.justpistols.co.uk/resources.htm>. Apr. 21, 2009.*

* cited by examiner

*Primary Examiner* — Gabriel Klein
(74) *Attorney, Agent, or Firm* — Andrus, Sceales, Starke & Sawall, LLP

(57) ABSTRACT

A shotgun mounting system includes a shotgun having a receiver provided with a firing chamber adapted to receive and eject shotgun cartridges therefrom, a shell mounted on and at least partially covering the receiver and a rail arrangement located on the shell and adapted to mount a shotgun accessory to the shell in an adjustable position on the rail arrangement.

14 Claims, 4 Drawing Sheets

SHOTGUN MOUNTING SYSTEM

BACKGROUND OF THE INVENTION

The present disclosure relates generally to firearms and, more particularly, pertains to a mounting system added to the receiver of a shotgun for selectively attaching ancillary equipment thereto.

Various types of devices are useful as accessories for being mounted to firearms, such as shotguns. Examples of such accessories include scopes and other sighting equipment, illuminating devices, and shotgun shell or cartridge holders. Such accessories are conventionally mounted to an interface apparatus descriptively referred to as an accessory mount which has been variously secured to the shotgun. The accessory mount may include a rail interface system well known in the art pertaining to firearms. For example, it is known to attach one or more rails using fasteners that secure the rail longitudinally along a surface of a shotgun receiver.

There remains a need for an accessory mount capable of securing accessories to a receiver of a shotgun that conforms to the shape and size of the receiver, and provides mounting surfaces adjacent the top and side surfaces of the receiver. There is an additional need for such an accessory mount that is constructed with a dovetail rail arrangement having a frictional interface for slidably receiving and retaining accessories thereon. Further, there is a need for an accessory mount which will not add significant weight to the shotgun, and will provide reduction of heat generated by the receiver during firing of cartridges therein.

SUMMARY OF THE INVENTION

The present disclosure relates to a shotgun mounting system including a shotgun having a receiver provided with a firing chamber adapted to receive and eject shotgun cartridges therefrom. A shell is mounted on and at least partially covers the receiver. A rail arrangement is located on the shell and is adapted to mount a shotgun accessory to the shell in an adjustable position on the rail arrangement.

The shell is sized and shaped similar to the size and shape of the receiver. The shell has an inverted, generally U-shape defined by an upper wall that connects a pair of sidewalls depending from the upper wall. The upper wall of the shell lies adjacent an upper portion of the receiver, and the sidewalls of the shell lie adjacent side portions of the receiver. The shell has a front edge that, in use, extends to a front end of the receiver, a back edge that extends to a back end of the receiver and a pair of bottom edges that lie adjacent a bottom end of the receiver. The upper wall extends rearwardly from the front edge and includes a tapered portion that slopes downwardly toward the back edge. The upper wall has a substantially solid surface along one portion thereof, and a substantially reticulated surface along another portion opposite the one portion. One of the sidewalls has a generally solid planar surface depending from the solid surface of the upper wall. The one sidewall is formed with an opening designed to be shaped similarly to and be aligned with an ejection port in the receiver, and has a mounting hole configured to receive a retainer that passes transversely through the receiver to secure the shell thereto. The other of the sidewalls has a reticulated surface along upper and lower portions thereof, and is formed with a mounting hole aligned with the mounting hole formed in the one sidewall. The rail arrangement has a dovetail cross section and a grooved outer surface. The rail arrangement includes a top rail extending longitudinally along the upper wall, and a side rail extending longitudinally on each of the sidewalls.

The present disclosure further relates to a shotgun accessory mount including an inverted, generally U-shaped shell adapted to be slip fit over a receiver of the shotgun. The shell has a pair of sidewalls connected by an upper wall. A rail arrangement is located on the shell and formed with a dovetail cross section adapted to slidably mount a shotgun accessory to the shell. The rail arrangement includes a top rail running longitudinally along the upper wall, and a side rail extending longitudinally on each of the sidewalls. The top and side rails have varying lengths with one of the side rails being longer than the top rail, and the top rail being longer than the other side rail. The top rail runs centrally along the upper wall, while the side rails are positioned generally medially between the upper wall and the bottom edges of the sidewalls. The top and side rails form mounting surfaces designed to receive and retain shotgun accessories, such as scopes and other sighting peripherals, lighting or laser devices, and shotgun shell or cartridge holders to enhance the capability and performance of the shotgun.

BRIEF DESCRIPTION OF THE DRAWINGS

The drawings illustrate the best mode presently contemplated in carrying out the disclosure. In the drawings.

DETAILED DESCRIPTION OF THE INVENTION

Figure 1:
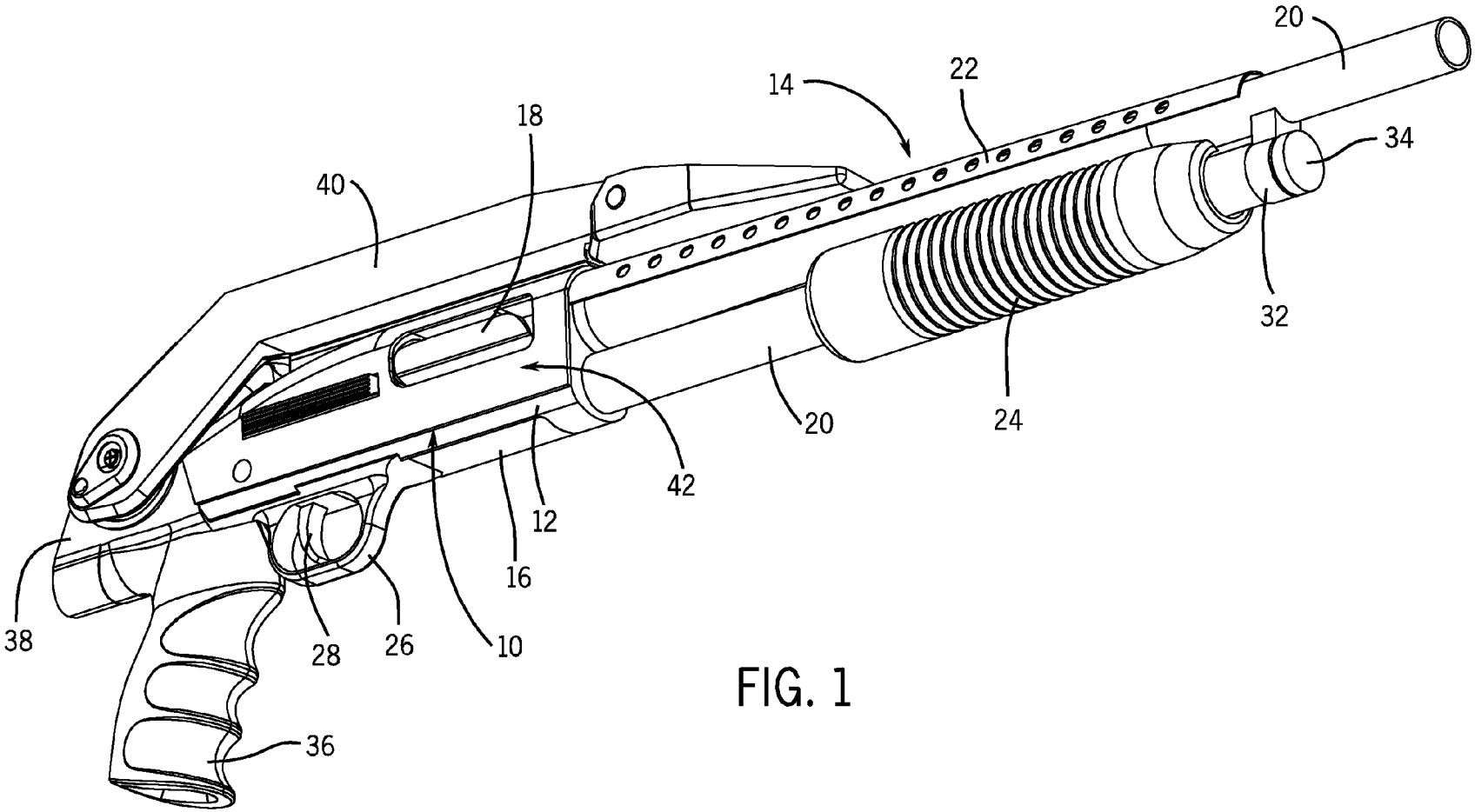
FIG. 1 is a perspective view of a shotgun provided with an exemplary embodiment of an accessory mount for enabling the attachment of accessories thereto as viewed from one side of the shotgun.

In accordance with the present disclosure, FIG. 1 illustrates an accessory mount 10 removably mounted to and substantially covering a receiver 12 of a shotgun 14 for enabling the attachment of accessories thereto. The receiver 12 includes a bottom loading port 16 for receiving live shotgun cartridges, and a side ejection port 18 for ejecting spent shotgun cartridges from an internal firing chamber. The shotgun 14 includes a barrel 20 having a cover 22, a gripping, slidable forend 24, a trigger guard 26 and a trigger 28. The shotgun 14 shown also includes a cartridge-storing magazine tube 30 that extends longitudinally from the receiver 12 and below the barrel 20 with a forward portion of the mounting tube 30 engaging a barrel lug 32 and held thereto by a magazine cap 34. In addition, the shotgun 14 is equipped with a pistol grip 36 connected via a mounting device 38 below and at the rear end of the receiver 12. An over the top stock 40 can be pivotally moved on the shotgun 14 from a retracted position over the accessory mount 10 and barrel cover 22 to an extended portion for engagement with a shooter's shoulder.

Referring now to FIGS. 2-6, the accessory mount 10 includes an inverted generally U-shaped shell 42 integrally formed with an arcuate upper wall 44 and a pair of opposed sidewalls 46, 48 depending downwardly from the upper wall 44. The shell 42 is suitably sized and shaped so as to be slipped over and carried in aligned relationship by corresponding upper and sidewall portions of the receiver 12. The upper wall 44 and sidewalls 46, 48 define a front edge 50 extending to a front end of the receiver 12 adjacent the barrel cover 22, a back edge 52 extending to a back end of the receiver 12 adjacent the mounting device 38 and a pair of bottom edges 54, 56 that lie adjacent a bottom surface of receiver 12 when the mount 10 is disposed thereon. Using fabrication methods well known in the art, the shell 42 is manufactured preferably of rigid materials including lightweight metals, polymers and composites.

Figure 2:
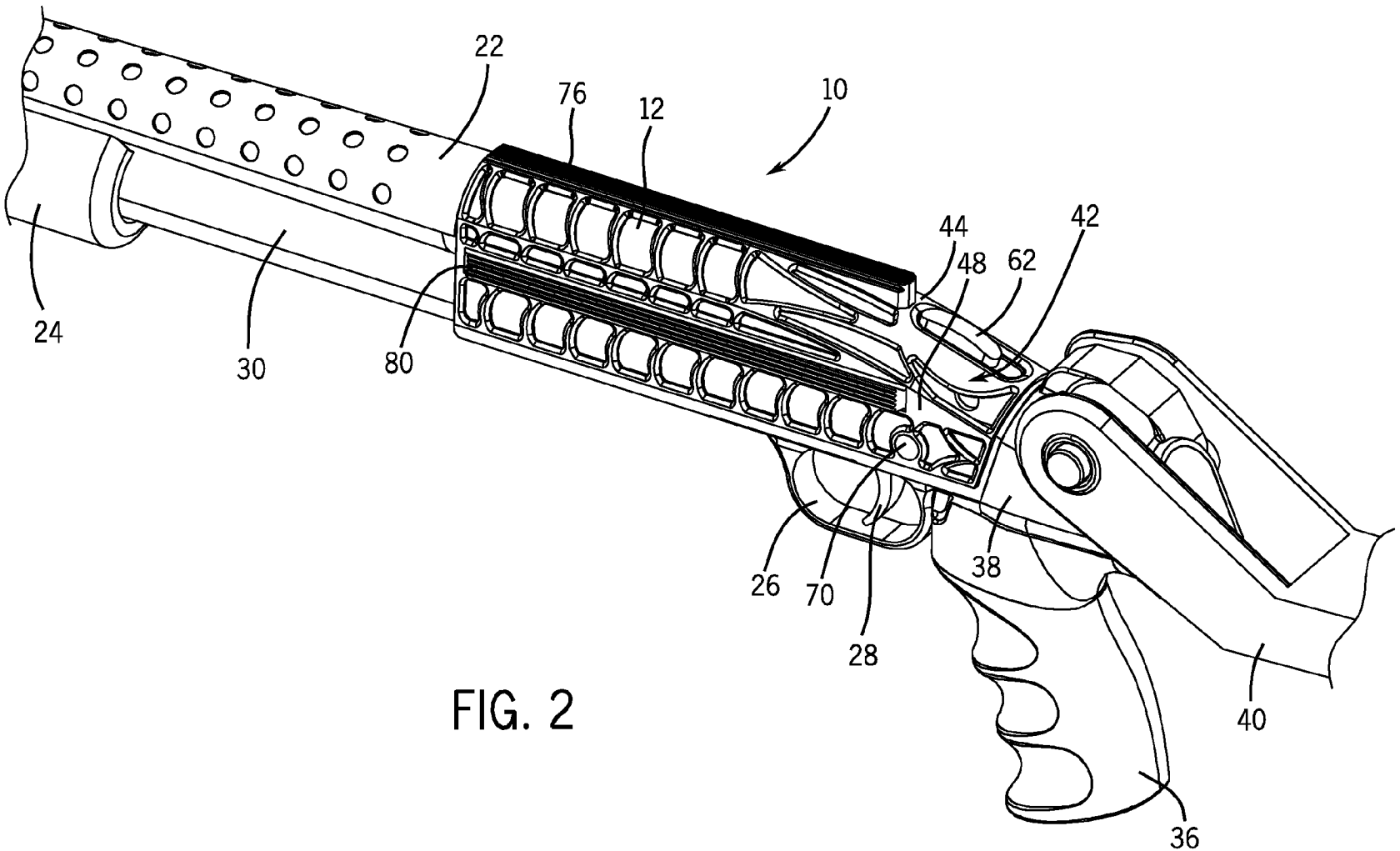
FIG. 2 is a fragmentary perspective view of the accessory mount of FIG. 1 as viewed from an opposite side of the shotgun shown with an over the top stock pivoted to an extended position.
Figure 3:
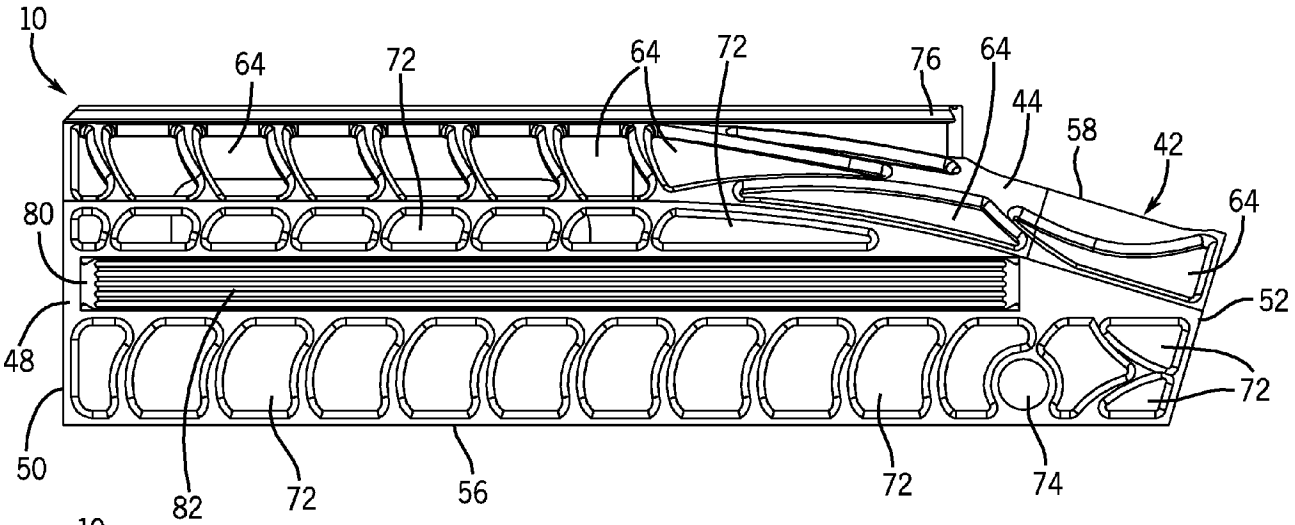
FIG. 3 is a side elevational view of the accessory mount shown in FIG. 2.
Figure 4:
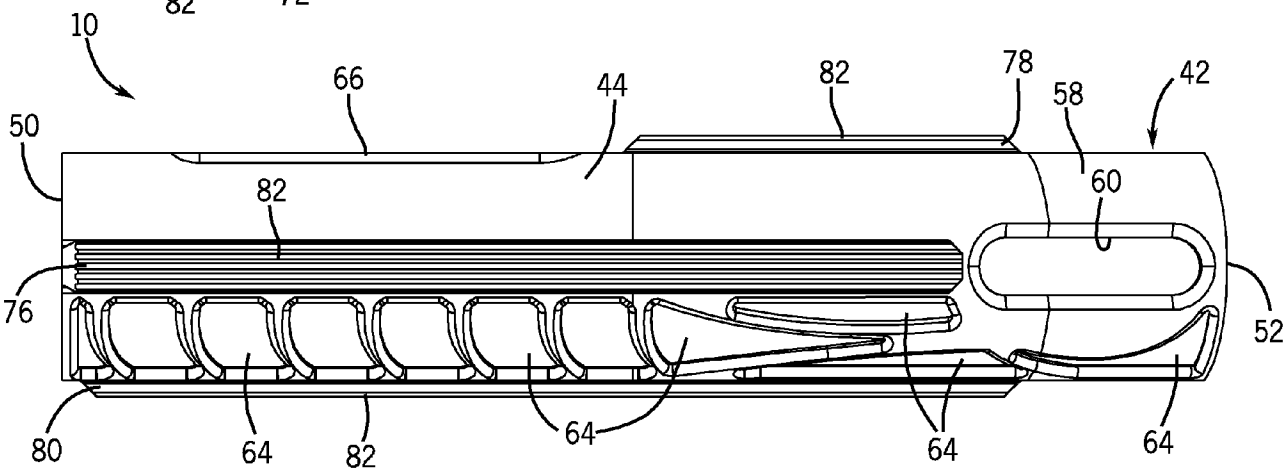
FIG. 4 is a top plan view of the accessory mount shown in FIG. 3.
Figure 5:
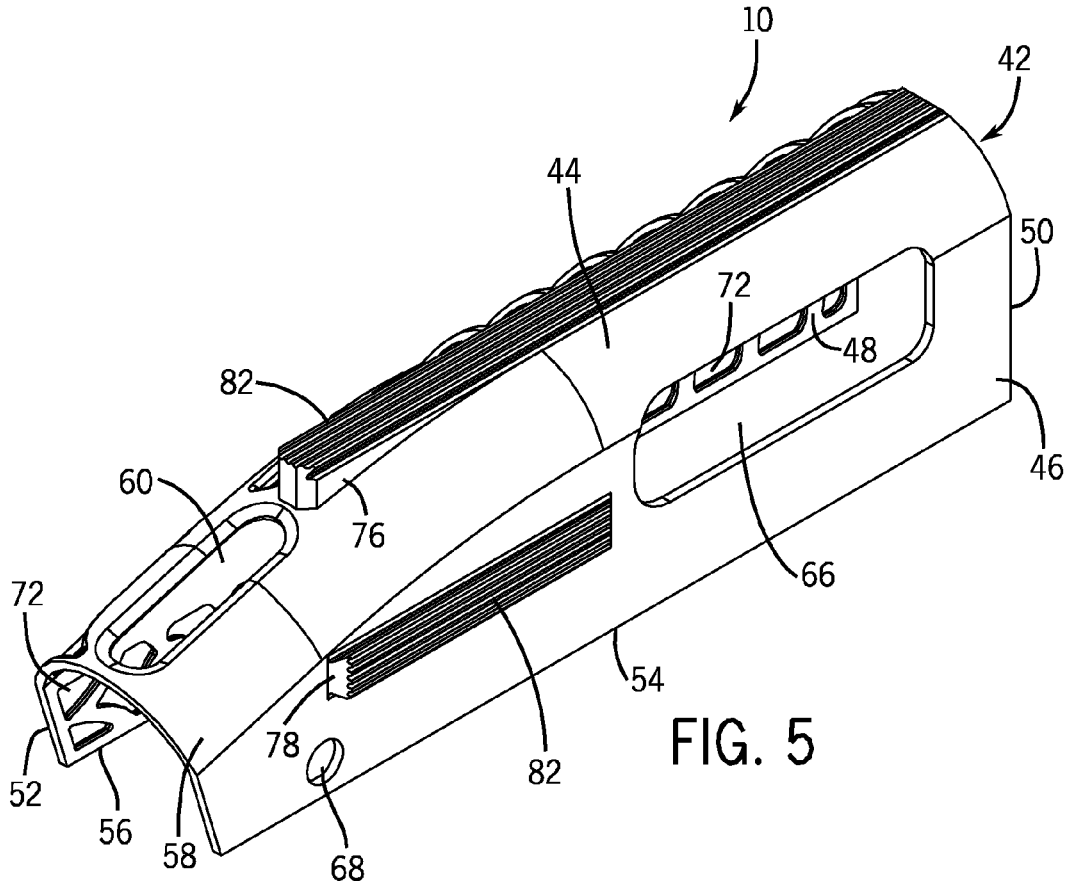
FIG. 5 is a perspective view of the accessory mount of FIG. 1 shown removed from the shotgun.
Figure 6:
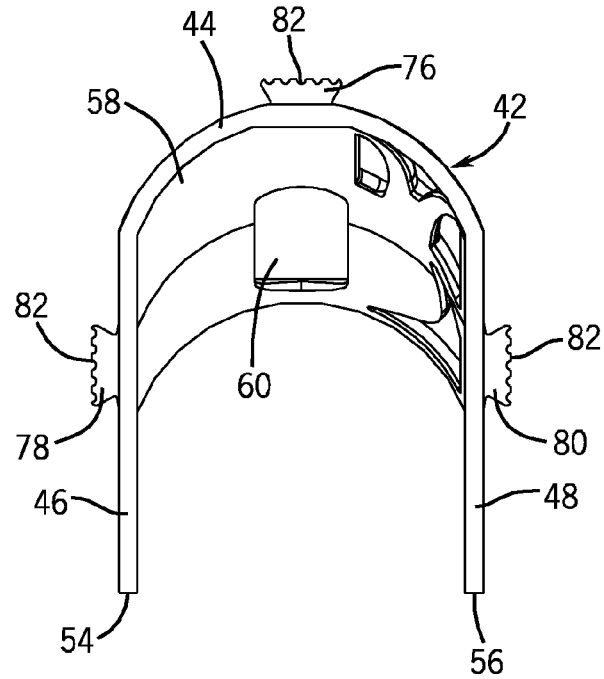
FIG. 6 is a front end view of FIG. 5.

As seen best in FIGS. 5 and 6, the upper wall 44 of shell 42 has a tapered portion 58 that slopes downwardly towards the back edge 52. The tapered portion 58 of upper wall 44 is formed with an elongated aperture 60 for receiving a protruding member 62 (FIG. 2) of the receiver 12 when the shell 42 is in use. As seen in FIGS. 2 and 4, the upper wall 44 has a substantially solid surface along one half side thereof, and a substantially reticulated surface along a half side opposite the solid surface. The reticulated surface includes a number of differently sized and shaped materially-relieved apertures 64 designed for weight reduction of the upper wall 44. In addition, the apertures 64 provide for reduction of heat from the fired explosions of cartridges in the receiver 12 lying beneath the upper wall 44.

The sidewall 46 has a generally solid planar surface depending from the solid surface of upper wall 44 except for an opening 66 formed in a forward portion thereof, and a mounting hole 68 formed in a rearward portion thereof. The opening 66 is designed to be shaped similarly to and be aligned with the ejection port 18 of the receiver 12. The mounting hole 68 is configured to receive a retainer 70 that passes transversely through the receiver 12 to secure the shell 42 thereto. Similar to the reticulated surface of upper wall 44, upper and lower portions of the sidewall 48 are formed with a plurality of differently sized and shaped materially-relieved apertures 72 for providing weight and heat reduction. Sidewall 48 is provided with a mounting hole 74 that is aligned with the mounting hole 68 on sidewall 46.

The exemplary embodiment of the accessory mount 10 includes a rail arrangement that is provided longitudinally on and extends outwardly from the shell 42. More specifically, the rail arrangement is defined by a top rail 76 on upper wall 44, a side rail 78 on sidewall 46 and a side rail 80 on sidewall 48. Each of the rails 76, 78, 80 is commonly constructed with a dovetail cross section having a grooved outer surface 82. The rails 76, 78, 80 have varying lengths with the side rail 80 being longer than the top rail 76 which is longer than the side rail 78. The top rail 76 runs centrally along the upper wall 44, while the side rails 78, 80 are positioned generally medially between the upper wall 44 and the bottom edges 54, 56 of sidewalls 46, 48, respectively. Although not illustrated, the grooved outer surfaces 82 of the rails 76, 78, 80 may be provided with a series of holes used in receiving fasteners employed in further securing shotgun accessories to the rails.

The rails 76, 78, 80 form mounting surfaces designed to receive and retain firearm accessories, such as scopes and other sighting peripherals, lighting or laser devices, shotgun shell or cartridge holders, etc. to enhance the capability and performance of the shotgun 14. While the exemplary embodiment describes the rails 76, 78, 80 as having the structure described above, it should be understood that the disclosure contemplates using rails that provide a different mounting structure or configuration on the shell 42. Although the rail arrangement described has single rails along the upper wall 44 and sidewalls 46, 48 of the shell 42, it should be appreciated that multiple rails could be provided on the upper wall 44 and sidewalls 46, 48, if desired.

To install the accessory mount 10, a user simply pivots the over the top stock 40 to the retracted position shown in FIG. 2 to fully expose the receiver 12. Shell 42 is then disposed over the receiver 12 so that the opening 66 is aligned with the ejection port 18 on the receiver 12 after which the retainer 70 is passed transversely through a passageway formed in the receiver 12 and the holes 68 and 74. Shotgun accessories can then be slidably mounted in an adjustable position along one or more of the rails 76, 78, 80 on the shell 42. Removal of the accessory mount 10 is quickly accomplished by removing the retainer 70 and lifting the shell 42 from the receiver 12.

Various alternatives are contemplated as being within the scope of the following claims particularly pointing out and distinctly claiming the subject matter regarded as the invention.

What is claimed is:

1. A shotgun mounting system comprising in combination:

a shotgun having a receiver provided with a firing chamber adapted to receive and eject shotgun cartridges therefrom;

a shell mounted on and at least partially covering the receiver; and a rail arrangement located on the shell and adapted to mount a shotgun accessory to the shell in an adjustable position on the rail arrangement, wherein the shell has an inverted, generally U-shape defined by an upper wall that connects a pair of sidewalls depending from the upper wall, wherein the shell has a front edge that extends to a front end of the receiver, a back edge that extends to a back end of the receiver, and a air of bottom edges that lie adjacent a bottom end of the receiver, wherein the upper wall extends rearwardly from the front edge and includes a tapered portion that slopes downwardly towards the back edge, and includes an elongated aperture receiving a portion of the receiver, wherein one of the sidewalls is formed with an elongated opening designed to be aligned with an ejection port in the receiver, and the other of the sidewalls has upper and lower portions formed with separate reticulated surfaces, and wherein the rail arrangement includes a top rail structure extending longitudinally along the upper wall between the front edge and the elongated aperture, a first side rail structure extending longitudinally along the one sidewall between the elongated opening and the back edge and a second side rail structure extending longitudinally along the other of the sidewalls between the front edge and the back edge and between the reticulated surfaces.

2. The mounting system of claim 1, wherein the shell is removably mounted to the receiver.

3. The mounting system of claim 1, wherein the upper wall of the shell lies adjacent an upper portion of the receiver, and the sidewalls of the shell lie adjacent side portions of the receiver.

4. The mounting system of claim 1, wherein the upper wall has a solid surface along one portion thereof, and a reticulated surface along another portion opposite the one portion.

5. The mounting system of claim 4, wherein the one of the sidewalls has a generally solid planar surface depending from the solid surface of the upper wall.

6. The mounting system of claim 5, wherein the one sidewall has a mounting hole configured to receive a retainer that passes transversely through the receiver to secure the shell thereto.

7. The mounting system of claim 6, wherein the other of the sidewalls has a mounting hole aligned with the mounting hole formed in the one sidewall.

8. The mounting system of claim 1, wherein the rail arrangement has a dovetail cross section and a grooved outer surface.

9. A shotgun accessory mount comprising:

an inverted generally U-shaped shell having a front edge and a back edge adapted to be slip fit over the receiver of the shotgun, the shell having a pair of sidewalls connected by an upper wall; and a rail arrangement located on the shell and formed with a dovetail cross section adapted to slidably mount a shotgun accessory to the shell, wherein the upper wall includes a tapered portion that extends towards the back edge and is formed with an elongated aperture adapted to receive a portion of the receiver, wherein one of the sidewalls is formed with an elongated opening adapted to be aligned with an ejection port in the receiver, and the other of the sidewalls has upper and lower portions formed with separate reticulated surfaces, and wherein the rail arrangement includes a top rail structure extending longitudinally along the upper wall between the front edge and the elongated aperture, a first side rail structure extending longitudinally along the one sidewall between the elongated opening and the back edge and a second side rail structure extending longitudinally along the other of the sidewalls between the front edge and the back edge and between the reticulated surfaces.

10. The accessory mount of claim 9, wherein the upper wall has a solid surface along one portion thereof, and a reticulated surface along another portion opposite the one portion.

11. The accessory mount of claim 9, wherein the one of the sidewalls has a generally solid planar surface depending from the solid surface of the upper wall.

12. The accessory mount of claim 11, wherein the one sidewall has a mounting hole configured to receive a retainer.

13. The accessory mount of claim 12, wherein the other of the sidewalls has a mounting hole aligned with the mounting hole formed in the one sidewall.

14. The accessory mount of claim 9, wherein the rail arrangement is provided with a grooved outer surface.

* * * * *